United States Patent [19]

Gilat et al.

[11] Patent Number: 5,016,801

[45] Date of Patent: May 21, 1991

[54] MULTIPLE-PLY WEB REGISTRATION APPARATUS

[75] Inventors: Ronen Gilat; David B. Boyd, both of Omaha, Nebr.

[73] Assignee: Industrial Label Corporation, Omaha, Nebr.

[21] Appl. No.: 574,270

[22] Filed: Aug. 28, 1990

[51] Int. Cl.[5] ..... B65H 23/32

[52] U.S. Cl. ..... 226/197; 226/199

[58] Field of Search ..... 226/197, 199, 196; 83/107

[56] References Cited

U.S. PATENT DOCUMENTS

| | | | |
|---|---|---|---|
| 2,284,318 | 5/1942 | Hamlin | 226/197 X |
| 3,103,843 | 9/1963 | Schoenberger et al. | 83/107 |
| 3,399,884 | 9/1968 | Bahrani | 226/197 X |
| 3,809,303 | 5/1974 | Brunner | 226/197 |

*Primary Examiner*—Daniel P. Stodola
*Assistant Examiner*—P. Bowen
*Attorney, Agent, or Firm*—Zarley, McKee, Thomte, Voorhees & Sease

[57] ABSTRACT

A multiple-ply web registration apparatus includes a frame through which a pair of webs enter in side-by-side relation and exit in juxtaposed registered relation. A pair of turning bars are mounted within the frame and oriented obliquely with respect to the direction of travel of the webs. The first web is wrapped around the turning bars to laterally shift the web over the top of the second web. At least one of the turning bars is adjustable towards and away from the other turning bar so as to permit adjustment of the lateral shifting of the first web with respect to the second web. The second web extends around an idler roller within the frame, which is adjustable so that the distance traveled by the second web is identical to the distance traveled by the first web.

3 Claims, 4 Drawing Sheets

MULTIPLE-PLY WEB REGISTRATION APPARATUS

TECHNICAL FIELD

The present invention relates generally to web-handling apparatus, and more particularly to an apparatus for continuously combining more than one web to produce an accurately-registered multiple-ply web, in a single operation.

BACKGROUND OF THE INVENTION

Multiple-ply web structures serve many purposes, such as for redeemable coupons with an upper layer peelable from a lower layer mounted directly on a product. Currently, the industry utilizes multiple webs introduced through a printing press having printing stations for each color on every ply of the finished multiple-ply label or coupon. The current process also requires the application of a glue which is applied in liquid form and then permitted to cure or dry. Once the glue has cured, the upper ply of the multiple-ply structure can be removed from the lower ply and the glue surface should be dry to the touch.

Typically, the multiple-ply process calls for printing of the upper ply separately from the lower ply and then subsequent steps of registering the upper ply with the lower ply and applying glue and varnish. Thus, for a structure having a five color upper ply with single color back printing, and a five color lower ply, and of the type where protective varnish was required, the conventional process would require a printing press with thirteen individual printing stations to produce the multiple-ply structure. In such a case, the sequence would be as follows: (1) print the five color bottom label (five stations), print the five color top label (five stations), (2) print the single color on the back of the top label, (3) apply glue between the two plies, and (4) apply varnish to the surface of the top label. Thus, this sequence requires thirteen individual printing stations.

There are several drawbacks to this conventionally-utilized sequence. First, the number of printing stations to produce the end product is excessive. When operating a machine of this size, it becomes extremely difficult to monitor all phases of the process due to the size and length of the equipment. Thus, it is necessary to utilize more than one machine operator, or to install electronic devices to ensure accurate tension, accurate print registration, accurate ply-to-ply registration, and accurate label printing to die-cutting registration, all being maintained within acceptable tolerances.

Further, since it is fairly common for the upper and lower plies of a multiple-ply structure to utilize very similar graphics and colors, undesirable results can be obtained utilizing two separate printing processes, due to variances in the color or quality of the printing.

It is therefore a general object of the present invention to provide an improved apparatus for producing a multiple-ply web.

Another object of the present invention is to provide an apparatus for producing a multiple-ply web which eliminates separate printing of similar upper and lower plies.

A further object of the present invention is to provide an apparatus for producing a multiple-ply web which is adjustable to various width webs, and various label dimensions.

These and other objects will be apparent to those skilled in the art.

SUMMARY OF THE INVENTION

The multiple-ply web registration apparatus of the present invention is designed to juxtapose a first web having a series of labels printed thereon onto a second web having a series of labels printed thereon, with the respective printed labels in registration. The registration apparatus includes a frame through which the webs enter in side-by-side relation and exit in juxtaposed registered relation. A pair of turning bars are oriented within the frame obliquely with respect to the direction of travel of the webs. The first web is wrapped around the turning bars to laterally shift the web over the top of the second web. At least one of the turning bars is adjustable towards and away from the other turning bar so as to permit adjustment of the lateral shifting of the first web with respect to the second web. The second web extends around an idler roller within the frame which is adjustable so that the distance traveled by the second web is identical to the distance traveled by the first web.

DESCRIPTION OF THE PREFERRED EMBODIMENT

Figure 1:
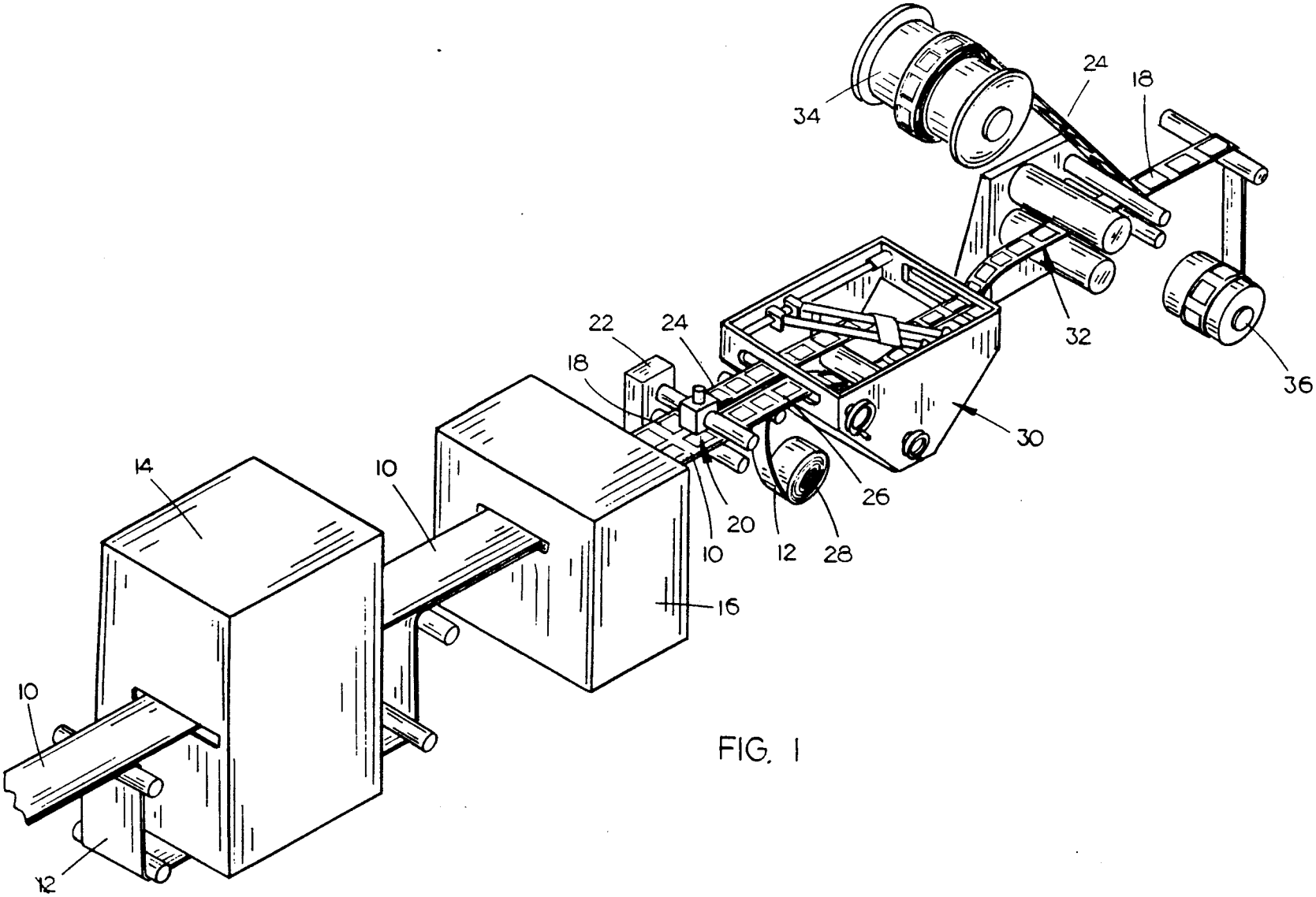
FIG. 1 is a pictorial view of the sequence of events in producing a multiple-ply web.
Figure 2:
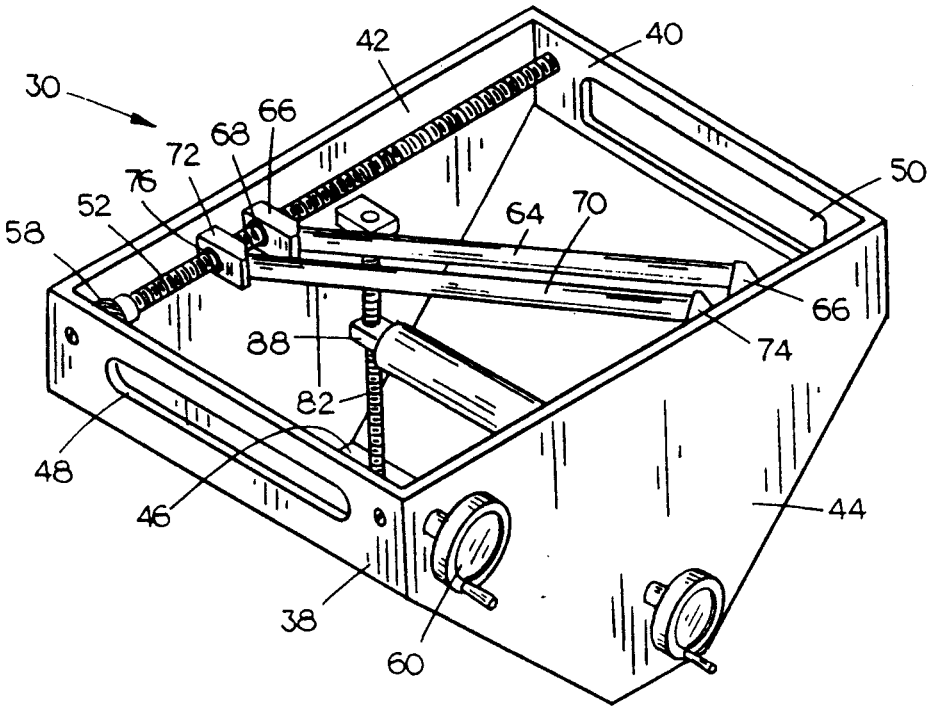
FIG. 2 is a perspective view of the multiple-ply registration apparatus of the present invention.
Figure 3:
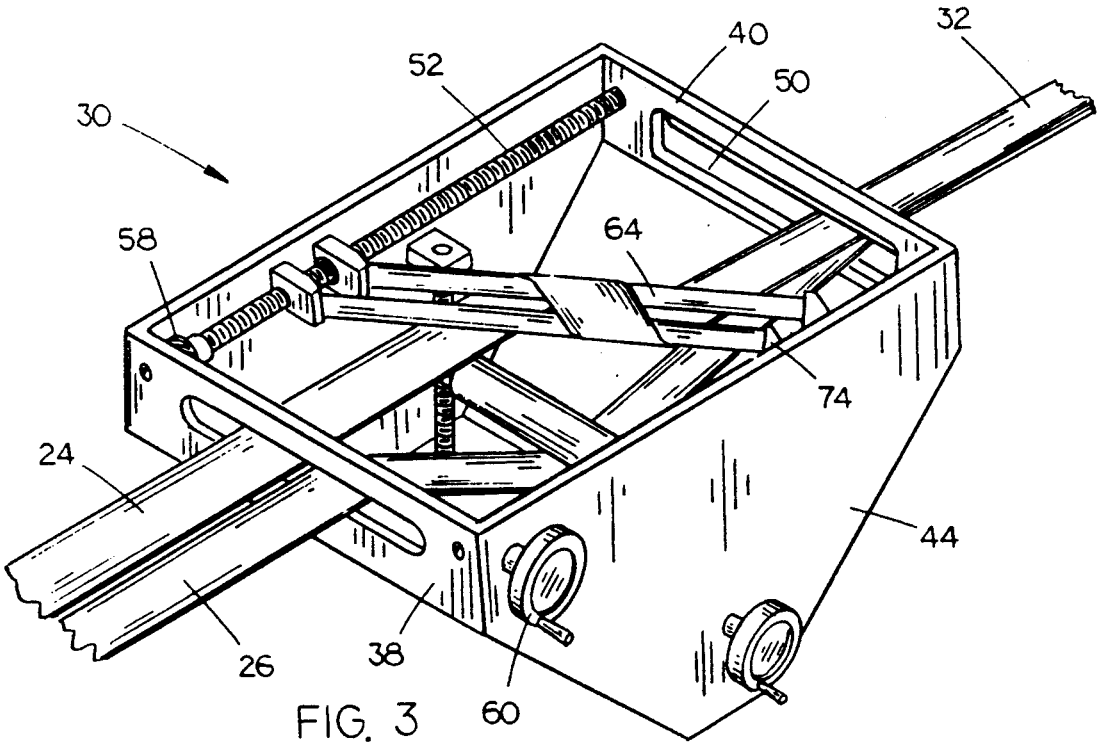
FIG. 3 is a perspective view similar to FIG. 2, with a pair of plies of a web threaded through the invention.
Figure 4:
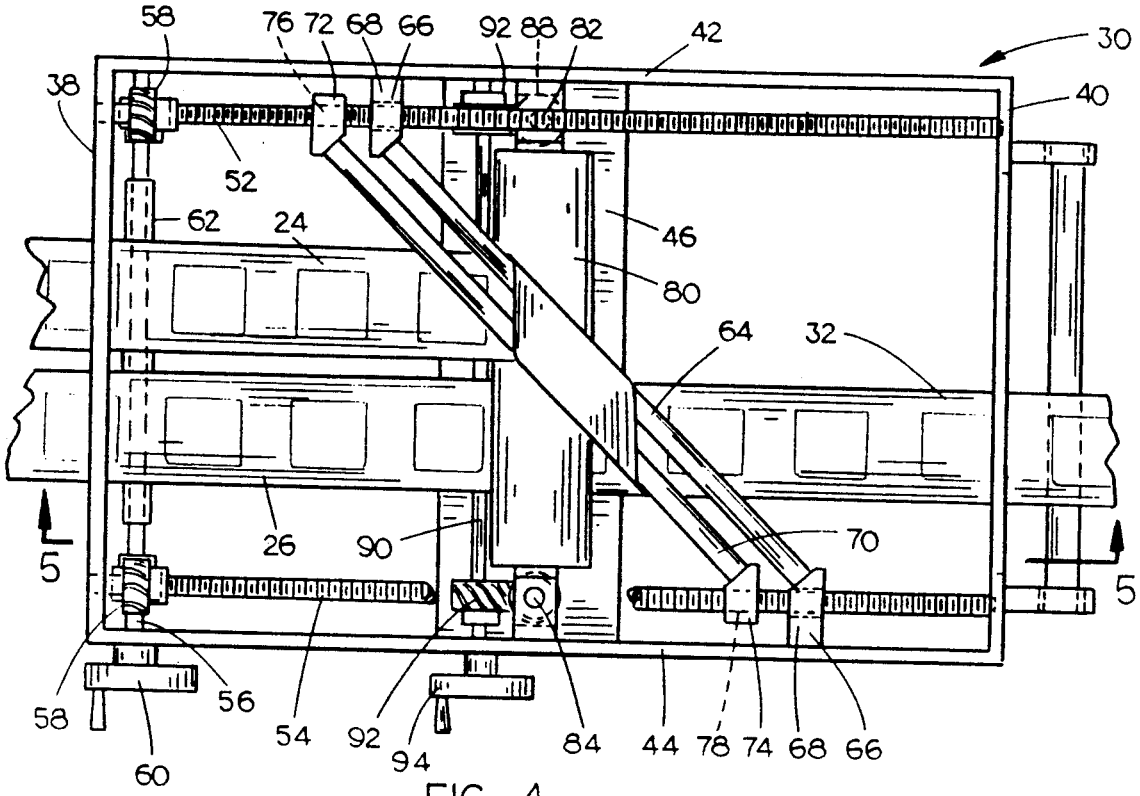
FIG. 4 is a top view of the apparatus of FIG. 3.

Referring now to the drawings, in which similar or corresponding parts are identified with the same reference numeral, and more particularly to FIG. 1, a pictorial diagram of the sequence of events in producing a multiple-ply web is depicted. Beginning at the left hand portion of the Figure, a continuous web 10 with a lower liner 12 is provided, the liner 12 being pulled away from the web 10 as web 10 enters a back printing station identified generally at 14. Back printing station 14 will print on the lower surface of web 10 as desired. After exiting back printing station 14, liner 12 is reapplied to web 10 and the combined web enters a face printing station 16.

Face printing station 16 will print at least two longitudinal rows of labels, one row of labels identified generally at 18 and a second row of labels identified generally at 20. Web 10 is then split into two separate webs by a cutter 22. A circular blade (not shown) splits web 10 into a first web 24 which has the first row of labels 18 thereon, and a second web 26 which has the second row of labels 20 thereon. The liner 12 is removed from first web 24 and rolled on a reel 28 prior to the introduction of first and second webs 24 and 26 into the multiple-ply web registration apparatus 30 of the present invention.

As will be described in more detail hereinbelow, the apparatus 30 of the present invention will register labels 18 on first web 24 directly on top of labels 20 on second web 26 to produce a multiple-ply web identified generally as 32. The excess portion of first web 24 surrounding labels 18 is then removed and stored on a reel 34. The web 32 with multiple-ply labels thereon is then stored on a reel 36 or individually sheeted and collected.

Referring now to FIGS. 2–5, the multiple-ply web registration apparatus 30 of the present invention includes a forward panel 38 and opposing rearward panel 40 separated by a pair of generally triangular shaped side panels 42 and 44. The lower ends of side panels 42 and 44 are connected by a bottom plate 46 to form a rigid three dimensional structure. A slot 48 in forward panel 38 will receive first and second webs 24 and 26 as they enter the apparatus 30. A slot 50 in rearward panel 40 will receive multiple-ply web 32 as it exists the apparatus 30. A threaded shaft 52 is rotatably mounted between forward and rearward panels 38 and 40 adjacent and parallel to side panel 42. A similar threaded shaft 54 is mounted parallel to shaft 52 and adjacent side panel 44. A drive shaft 56 is mounted transversely between side panels 42 and 44 parallel and adjacent to forward panel 38, immediately under threaded shafts 52 and 54. A pair of gear sets 58 are mounted at each end of drive shaft 56 to directly interconnect drive shaft 56 with threaded shafts 52 and 54, so as to directly transmit the rotational movement of the drive shaft to the threaded shafts. Drive shaft 56 protrudes through side panel 44, and a handle 60 is connected thereto to permit manual rotation of the drive shaft. An idler roller 62 is freely rotatable on drive shaft 56, and supports first and second webs 24 and 26 as they enter the apparatus 30.

A first cylindrical turning bar 64 is mounted between a pair of support blocks 66 which are affixed to side panels 42 and 44 respectively, such that first turning bar 64 is oriented at a 45° angle An aperture 68 in each support block receives threaded rods 52 and 54 and permits free rotation thereof through the support block 66.

A second cylindrical turning bar 70 is mounted between a support block 72 and a support block 74. Support block 72 has an aperture 76 which is interiorly threaded to correspond with threaded shaft 52, and support block 74 has an aperture 78 which is interiorly threaded to correspond with the threads on threaded shaft 54. Second turning bar 70 is mounted parallel to first turning bar 64, with support blocks 72 and 74 engaging threaded shafts 52 and 54 to move forwardly and rearwardly upon rotation of the threaded shafts 52 and 54. Thus, manual rotation of handle 60 and drive shaft 56 permits full control of the distance between first and second turning bars 64 and 70. An adjustable idler roller 80 is rotatably mounted at each end to a pair of vertical threaded rods 82 and 84. Idler roller is oriented transversely between side panels 42 and 44, perpendicular to the direction of travel of webs 24 and 26. Vertical threaded rods 82 and 84 are mounted between pairs of upper and lower bearings 86 to permit rotation of threaded rods 82 and 84. Idler roller 80 is rotatably supported on blocks 88, which are threaded to engage threaded rods 82 and 84. Thus, rotation of threaded rods 82 and 84 will cause idler roller 80 to move upwardly or downwardly within apparatus 30.

A drive shaft 90 extends between side panels 42 and 44 adjacent the lower ends of vertical threaded rods 82 and 84, and has gear sets 92 mounted at each end to engage vertical threaded rods 82 and 84. Thus, rotation of drive shaft 90 will simultaneously rotate threaded rods 82 and 84 to raise and lower idler roller 80. Drive shaft 90 extends through side panel 44, and has a handle 94 connected thereto to permit manual rotation of the drive shaft.

Figure 5:
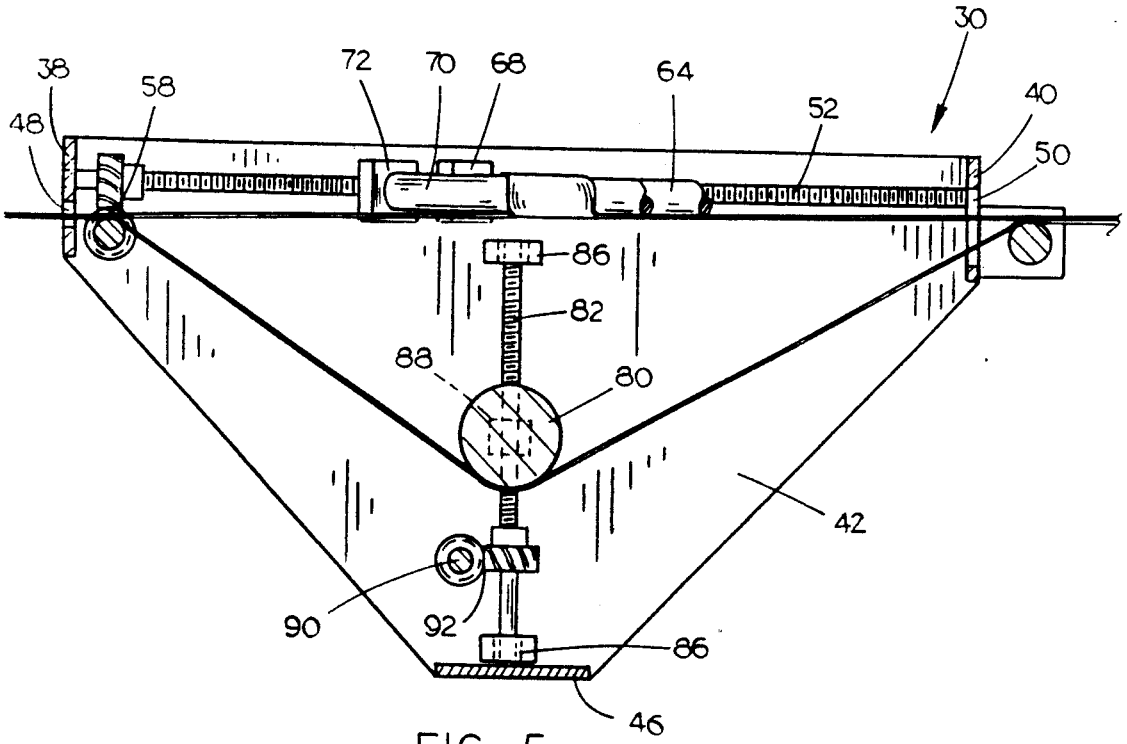
FIG. 5 is a sectional view taken at lines 5-5 in FIG. 4.
Figure 6:
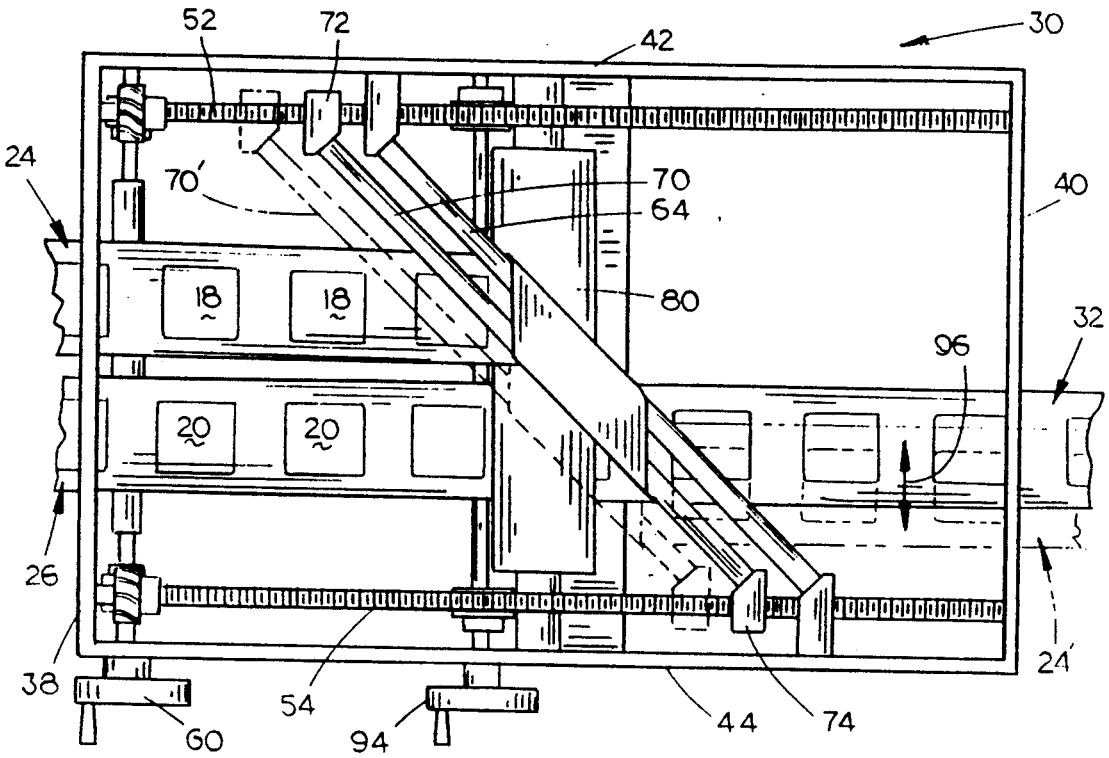
FIG. 6 is a view similar to FIG. 4, with a broken line drawing of an adjustment to the apparatus.

FIGS. 5 and 6 depict the adjustability of the present invention to provide accurate registration of the first web 24 on top of second web 26. FIG. 6 shows that movement of second turning bar 70 forward and away from first turning bar 64 will shift first web 24 transversely with respect to second web 26, as shown by arrow 96. The broken line position of first turning bar is indicated at 70', and is positioned forwardly, farther away from second turning bar 64 than the solid line first turning bar 70. It can be seen that this movement will shift web 24 laterally with respect to web 26 as shown by the broken line indication of first web designated at 24'. Movement of turning bar 70 towards second turning bar 64 would shift first web 24' in the opposite lateral direction. Thus, various widths of webs as well as various separations between the webs may be easily and accurately registered in the lateral direction by movement of first turning bar 70.

Figure 7:
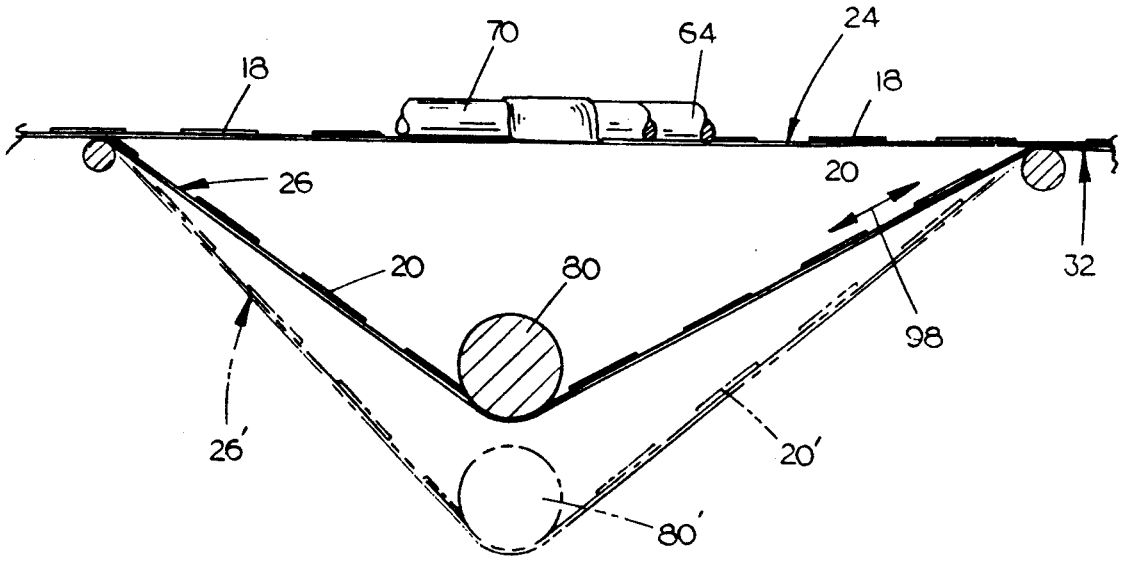
FIG. 7 is a view similar to FIG. 5, showing adjustment of the idler roller.

While movement of turning bar 70 will register webs 24 and 26 in the transverse direction, movement of idler roller 80 up or down will register first and second webs 24 and 26 in the longitudinal direction, as shown by arrow 98 in FIG. 7. Because web 24 is turned over turning bars 64 and 70, first web 24 will have a longer distance to travel between front panel 38 and rear panel 40 then will second web 26. In order to maintain accurate longitudinal registration between the labels 18 and 20 in the multiple-ply web 32, it is necessary to lengthen the distance of travel for second web 26 to be equal to the distance of travel of first web 24. This is accomplished by diverting second web 26 downwardly under idler roller 80 and thence upwardly to register with web 24. Vertical adjustability of idler roller 80 is shown in the broken line position of idler roller 80'. This downward movement of idler roller 80 lengthens the distance which web 26' will travel, and thereby adjust the longitudinal location of labels 20 with respect to labels 18 on first web 24. Adjustment of idler roller 80 coincides with adjustment of first turning bar 70 to accurately register webs 24 and 26 to perfectly align labels 18 on top of labels 20 to create multiple-ply web 32.

Whereas the invention has been shown and described in connection with the preferred embodiment thereof, it will be understood that many modifications, substitutions and additions may be made which are within the intended broad scope of the appended claims. There has therefore been shown and described an improved multiple-ply web registration apparatus which accomplishes at least all of the above stated objects.

We claim:

1. A multiple-ply web registration apparatus, for juxtaposing a first web having printed portions thereon on top of a second web with printed portions thereon, with the first web printed portions registered on top of the second web printed portions, comprising:

a frame having a forward end, rearward end and opposing parallel side panels;

a first turning bar connected between said side panels and located within a generally horizontal plane, said first turning bar oriented obliquely with respect to the side panels;

a second turning bar operably connected between said side panels, parallel to and coplanar with said first turning bar;

means for moving said second turning bar towards and away from said first turning bar while maintaining a parallel, coplanar relationship therewith;

an idler roller means operably connected between said side panels and perpendicular thereto, said idler roller means being spaced below said first and second turning bars and operable for movement within a generally vertical plane; and means for selectively moving said idler roller within said vertical plane.

2. A multiple-ply web registration apparatus for juxtaposing a first web having individual printed portions thereon onto a second web having individual printed portions thereon, with the respective printed portions in registration, comprising:

a frame having a forward end, rearward end and opposing side panels;

means for feeding said first and second webs through said forward end of said frame such that said webs are parallel and coplanar upon entering the frame;

said first and second webs exiting the frame through said second end with said first web registered on top of said second web, and exiting within a plane generally coplanar with the plane in which the webs entered the frame;

a first turning bar connected between said side panels and located within a generally horizontal plane, said first turning bar oriented obliquely with respect to the direction of travel of said first web through said frame;

a second turning bar operably connected between said side panels, parallel to and coplanar with said first turning bar;

said first web entering said frame, traveling to and wrapping around said turning bars, and then extending to exit the rearward end of the frame, such that said first web exits the frame shifted laterally and parallel to the path of travel of the first web entering the frame;

an idler roller means connected between said side panels and spaced below the plane in which the second web enters and exits the frame for redirecting the travel of said second web from the forward end to the rearward end of the frame, to adjust the distance traveled from the entrance to the exit; and means for selectively adjustably mounting said idler roller means for selective movement within a generally vertical plane, whereby the distance traveled by the second web from the entrance to the exit on the frame may be selectively adjusted.

3. The apparatus of claim 2, wherein said first turning bar is oriented at an approximate 45° angle with respect to the travel path of the first web.

* * * * *